United States Patent [19]

Runyon et al.

[11] Patent Number: 4,729,151

[45] Date of Patent: Mar. 8, 1988

[54] APPARATUS FOR ENTANGLING YARN

[75] Inventors: Robert C. Runyon, Dunwoody; Barry J. Hopson, Jonesboro, both of Ga.

[73] Assignee: RHS Industries, Inc., Atlanta, Ga.

[21] Appl. No.: 905,422

[22] Filed: Sep. 10, 1986

[51] Int. Cl.[4] ..... D02J 1/08

[52] U.S. Cl. ..... 28/276

[58] Field of Search ..... 28/258, 271, 274, 275, 28/276

[56] References Cited

U.S. PATENT DOCUMENTS

| | | | |
|---|---|---|---|
| Re. 31,376 | 9/1983 | Sheehan et al. . | |
| 2,783,609 | 3/1957 | Breen . | |
| 3,009,309 | 11/1961 | Breen et al. . | |
| 3,110,151 | 11/1963 | Bunting, Jr. et al. . | |
| 3,125,793 | 3/1964 | Gonsalves . | |
| 3,186,155 | 6/1955 | Breen et al. . | |
| 3,218,654 | 11/1965 | Yano et al. . | |
| 3,220,082 | 11/1965 | Fletcher et al. . | |
| 3,268,971 | 8/1966 | Lockwood, Jr. . | |
| 3,286,321 | 11/1966 | Fletcher et al. . | |
| 3,304,593 | 2/1967 | Burklund . | |
| 3,325,872 | 6/1967 | Ethridge et al. | 28/276 |
| 3,328,863 | 7/1967 | Cobb et al. . | |
| 3,377,673 | 4/1968 | Stoller . | |
| 3,389,444 | 6/1968 | Fletcher et al. . | |
| 3,823,448 | 7/1974 | Robets . | |
| 3,823,450 | 7/1974 | Ankudowicz et al. . | |
| 4,016,715 | 4/1977 | London, Jr. | 28/258 X |
| 4,064,686 | 12/1977 | Whitted et al. . | |
| 4,070,815 | 1/1978 | Negishi et al. | 28/276 X |
| 4,074,511 | 2/1978 | Chambley et al. . | |
| 4,083,172 | 4/1978 | Norris et al. . | |
| 4,138,840 | 2/1979 | Greenway et al. | 28/276 X |
| 4,223,520 | 9/1980 | Whitted et al. . | |
| 4,570,312 | 2/1986 | Whitener, Jr. . | |
| 4,644,620 | 2/1987 | Maeda | 28/274 X |
| 4,644,622 | 12/1987 | Bauer et al. | 28/274 X |

FOREIGN PATENT DOCUMENTS

| | | | |
|---|---|---|---|
| 2807410 | 8/1978 | Fed. Rep. of Germany . | |
| 59-066532 | 4/1984 | Japan . | |
| 60-88146 | 5/1985 | Japan | 28/276 |
| 1204676 | 9/1970 | United Kingdom . | |
| 298709 | 4/1971 | U.S.S.R. . | |

*Primary Examiner*—Robert R. Mackey

*Attorney, Agent, or Firm*—Jones, Askew & Lunsford

[57] ABSTRACT

There is disclosed an air entangling system consisting of an air jet and a tension isolator. In one embodiment, the tension isolator is a frictionless yarn guide or aspirator and in a second embodiment an idle roll has the yarn wrapped on it before entering the air jet and again after exiting the air jet. The air jet has a large annular air feed ring which supplies air to two tapered, diametrically opposed orifices of different sizes. An outlet dam with a well-rounded entrance, an increased inlet length, and polished internal surfaces all contribute to increased efficiency, speed, and consistency.

17 Claims, 8 Drawing Figures

APPARATUS FOR ENTANGLING YARN

BACKGROUND OF THE INVENTION

This invention relates generally to apparatus for entangling of multi-filament yarns, and more particularly concerns air jets and feed mechanisms which entangle multi-filament yarns at high speed, at reduced air pressure and air flow, and with consistently spaced tacks and blooms.

It is well known in the textile industry that continuous filament yarn bundles produced from a spinnerette have zero twist and perform poorly in many of the common textile operations such as winding, weaving, knitting, and the like. The poor performance is primarily due to the looseness of the structure that permits individual filaments to snap and break thus forming fluff balls, slubs, ringers, wraps, strip backs, or similar defects. Zero twist yarns also have a tendency to run in the form of a ribbon over guides, rollers and so forth whereby as a result of increased frictional contact, the yarns are more readily abraded and subject to breakage. As a result of these shortcomings, continuous filament producers usually carry out the additional step of twisting such continuous multi-filament yarn bundles to provide an acceptable starting product for fabric weaving, knitting, and carpet tufting. The twisting operation serves to compact and unify the yarn bundle thus resulting in a more cohesive structure which resists the pulling out of the individual filaments. The twisting operation, however, is expensive and time consuming and does not lend itself to continuous operation which characterizes much of the manufacturing process in the preparation of zero twist continuous multi-filament yarn bundles.

It is also well known in the textile industry that a multi-filament yarn bundle can be crimped by setting the yarn in a distorted configuration. Mechanical crimping, when used to achieve the distorted configuration, is time consuming and usually has limited processing speeds. Such mechanical crimping may also adversely affect the physical properties of the yarn.

In order to overcome the expense of a twisting operation, it is well known in the art to employ air jets to interlace and entangle the yarn to increase its bulk and to consolidate and unify the multi-filament yarn.

Early work regarding air entangling was directed primarily to consolidating and unifying the yarn bundle in order to impart integrity to the yarn bundle. In that regard, Bunting, et al., U.S. Pat. No. 3,110,151, discloses a number of different entangling jet configurations in which air is introduced into an entangling chamber while the yarn is continuously drawn through the entangling chamber. The jets and processes disclosed in the Bunting, et al. patents are specifically designed to interlace (called maypoling). The resulting yarn has periodic variations in the yarn structure but those variations are not observable with the unaided eye and are only observable with the aid of a microscope. Because the interlacing process in the Bunting, et al patent is carried out under positive tension with no mechanical overfeed, there is no tendency on the part of the yarn to bulk as a result of the action of the air jet. In addition, because bulking is not apparently an objective, the Bunting, et al. patent discloses consolidating light weight nylon yarns of 55 denier/17 filaments at speeds of 5000 yards per minute (yd./min.) using air at a pressure of 100 pounds per square inch gauge (psig.). Alternatively, heavier cellulose acetate yarns of 300 denier/80 filaments were run at only 100 yd./min. at an air pressure of 75 psig.

Fletcher, et al., U.S. Pat. No. 3,389,444 (and related U.S. Pat. Nos. 3,286,321 and 3,220,082) discloses various air jets for entangling yarns. Particularly, the Fletcher patent discloses processing zero twist yarns so that the yarn is relatively free of any loops or other noticable discontinuities. One jet disclosed in the Fletcher, et al. patent (FIG. 7) has diametrically opposed tapered air orifices on either side of the entangling chamber. The diametrically opposed air orifices are of equal size and are connected to a source of pressurized air by means of an annular chamber around the entangling chamber which results from inserting the cylindrical air jet into a bore at right angles to an intersecting bore. The resulting annular chamber is not cylindrical in shape (ring shape) but instead is half moon shaped on the sides of the bore connected to the air supply. Fletcher et al. also teaches polishing the surfaces of the entangling chamber to increase the closeness (periodic spacing) of the tacks. By using such an air jet, cellulose acetate yarn of 220 denier/15 filament is purportedly entangled at 714 meters per minute (m./min.) at air pressure of 66 psig (col. 8, lines 11–19, 47–66). The yarn however, had a loopy appearance with spots of extremely tight filament interweaving alternating with randomly occurring arch shaped loops. The yarn when woven into fabric had the appearance of containing staple yarn of poor uniformity plus some of the general effect of a skip dent type weave.

In order to provide yarn that is suitable for tufting into carpets, it is necessary to not only consolidate and unify the filaments in the yarn but to impart bulk to the yarn as well. In that regard, Whitted, et al. U.S. Pat. Nos. 4,223,520 and 4,064,686 disclose air entangling jets in which the air jets have two diametrically opposed equal diameter air orifices. In addition, the entangling chamber has a restricted outlet. Entangling is carried out by overfeeding the yarn into the entangling chamber at an overfeed rate of approximately 1½ to 2%. The air jets purportedly can entangle yarn of unspecified size at speeds of up to 2500 feet per minute (833 yd./min.) using air pressure between 80 and 180 psig. Commercial machines purportedly using the Whitted technology run carpet yarns of 1,000 to 2,000 denier at speeds of about 250–400 yds./min. and at pressures over 180 psig. The resulting yarn has alternate areas of high bulk (blooms) and compacted tacks.

Sheehan, et al. U.S. Pat. No. Re. 31,376 also discloses a yarn having alternating blooms and tacks. Sheehan, et al. does not disclose the particular air jet used but states that improved results are achieved by increasing the air pressure to between 100 and 200 psig and feeding the yarn of unspecified size under tension amounting to about a 2% underfeed.

Whitener U.S. Pat. No. 4,570,312 discloses a feed apparatus for an air entangling system to produce yarn having high bulk (blooms) and intervening compacted tacks by means of a double roll godet. Apparently because the yarn is wrapped on the godet before entering the air jet and after exiting the air jet, the pulsating tension created by the air jet causes the godet to alternatively speed up and slow down the feed of the yarn to the air jet to accommodate the bulking and tacking of the yarn. Such machines purportedly can run in speeds in excess of 1100 m./min. on yarns of unspecified size, but there is no disclosure of the air pressure required at that speed. It is believed that commercial machines using that arrangement for entangling carpet yarn of 1,000–2,000 denier will run at about 800–900 m./min. at air pressures in excess of 200 psig.

SUMMARY OF THE INVENTION

It is thus an object of the present invention to provide an air entangling jet and feed system which will consistently produce multi-filament yarn having alternating portions of high bulk and a compacted tacks.

It is further an object of the present invention to provide an air entangling jet and feed system which will entangle up to 3 yarns simultaneously each 2,600 denier/120 filaments at speeds of up to 1100 m./min. at air pressures below 150 psig while at the same time providing consistent entangling in terms of alternating areas of high bulk and compacted tacks.

In order to achieve the foregoing objectives, we have discovered that air pressure and air flow may be reduced by providing a novel air feed to the entangling chamber. A large annular ring is cut around the circumference of the air jet itself. Diametrically opposed, tapered orifices are then drilled through the reduced wall thickness of the air jet into the entangling chamber. The air jet with its large annular feed ring and tapered orifices is then inserted into a mounting block with the lower orifice mounted directly in line with the air feed passage in the air block. We have discovered that substantially increased performance is achieved by making the lower orifice, which is aligned with the air feed line in the mounting block, slightly larger than the upper orifice. Typically, the lower orifice is about 0.138 inch and the upper orifice is 0.120 inch. Finally, in addition to polishing the surface of the entangling chamber, we have found that air flow requirements and pressure can be further reduced by polishing the tapered orifices and the large cylindrical annular feed ring.

We have also discovered that the air pressure and air flow may be minimized by providing an outlet dam which constricts the outlet of the entangling chamber of the air jet. Particularly, such an outlet dam, although previously known in the art, should incorporate a well rounded hole at its entrance and an inside diameter just large enough to accommodate the yarn being entangled without excessive drag. The outlet dam with its well rounded entrance hole serves to eliminate escape of the air from the exit of the entangling chamber and to force the majority of the entangling air out through the entrance to the entangling chamber thereby conserving air and creating tension in the yarn within the entangling chamber. With that same consideration in mind, we have also discovered that increased tension in the entangling chamber can be created by lengthening the inlet length (distance between the inlet of the entangling chamber and the air orifice). For a one inch jet, having an inlet length of ½ inch, we have found that by doubling the inlet length to one inch and at the same time increasing the inside diameter of the entangling chamber, we can lower the air pressure and increase the consistency of entangling.

We have found, and conventional wisdom bears this out, that the degree of tension experienced by the yarn just prior to entering the entangling chamber is in some cases critical to the ability to entangle and the consistency of the entangling operation. We have found that it is necessary to provide some means of isolating the yarn from the whip and tensions that build up in the creel and guide network as the yarn is fed toward the air jet. In one embodiment, we provide an idle roller directly above and closely adjacent to the entrance of the entangling chamber. The yarn is wrapped around the idle roll once between the creel and the entrance of the entangling chamber and then wrapped around the idle roll again as it leaves the entangling chamber and proceeds to the winder. A second isolator, and a preferred isolator, is a frictionless yarn guide which comprises a feed chamber with a restricted entrance and with a single air orifice placed at an angle so that the air from the air orifice is directed toward the outlet of the feed chamber of the frictionless yarn guide. The air from the orifice in the yarn guide pulls the yarn into the feed chamber of the yarn guide and aspirates it out the outlet giving the yarn a small degree of a false twist. Because that twist is opposite in direction to the inherent false twist created at the inlet to the entangling jet, the two twists tend to cancel each other out so that the resulting entangled yarn exiting from the air entangling jet possesses zero twist.

Other objects and advantanges of the invention will become apparent upon reading the following detailed description and upon reference to the drawings.

DETAILED DESCRIPTION OF THE INVENTION

While the invention will be described in connection with the preferred embodiment, it will be understood that we do not intend to limit the invention to those embodiments. On the contrary, we intend to cover all alternatives, modifications, and equivalents as may be included within the spirit and scope of the invention as defined by the appended claims.

Figure 1:
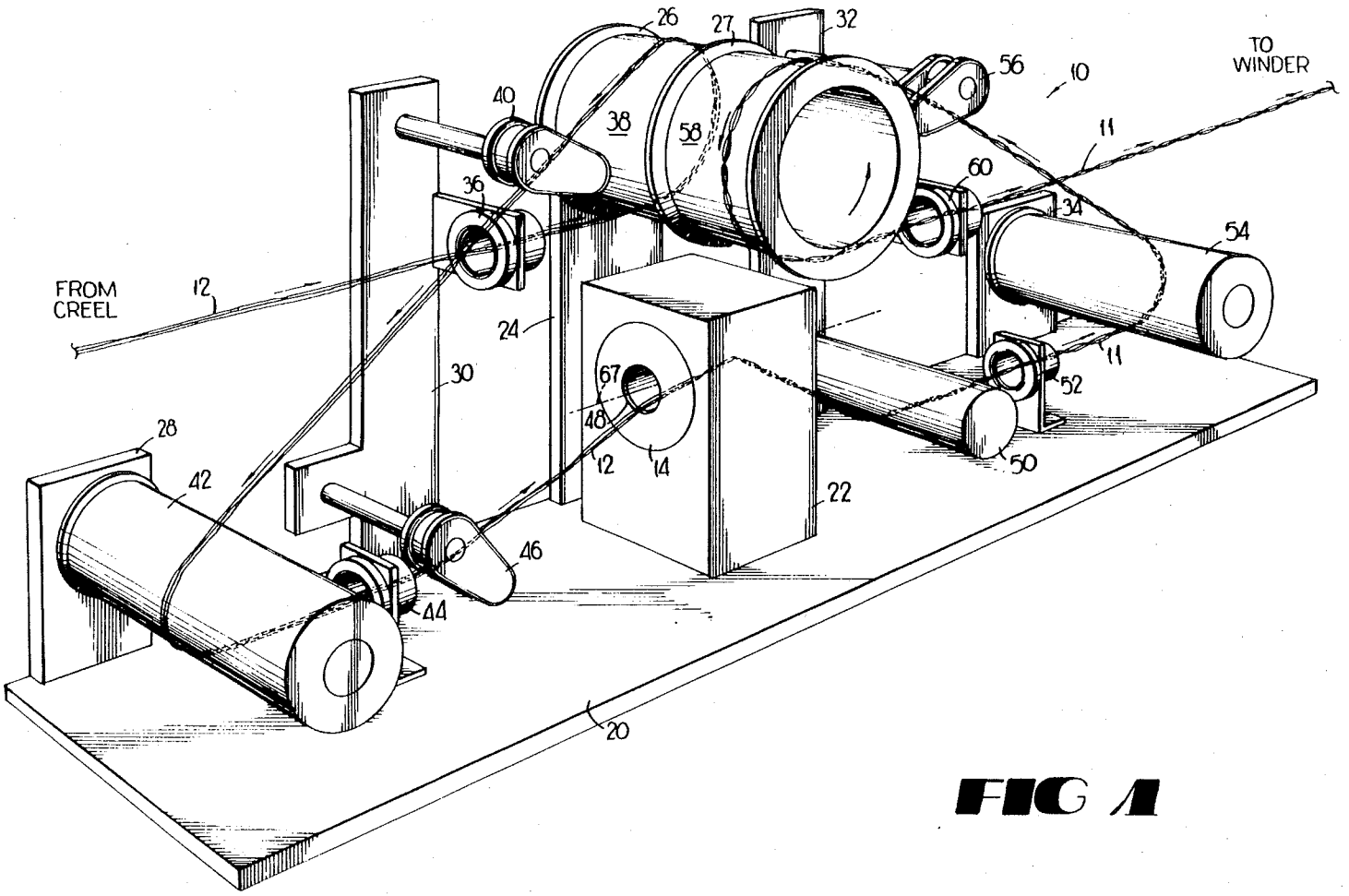
FIG. 1 is a perspective view of a system in accordance with the present invention for entangling yarn using an air entangling jet.

Turning to FIG. 1 there is shown a system 10 for entangling one or more multi-filament yarns 12 using an air jet 14. Unentangled yarn 12 is drawn from a creel (not shown) through entangling system 10 by a conventional winder (not shown). The unentangled yarn 12 may be a single yarn with a number of individual continuous filaments or it may consist of several yarns to be entangled together each possessing a number of individual filaments. The entangling system 10 consolidates the multi-filaments and gives the resulting entangled yarn 11 bulk as a result of alternating tacks and blooms.

Figures 7, 8:
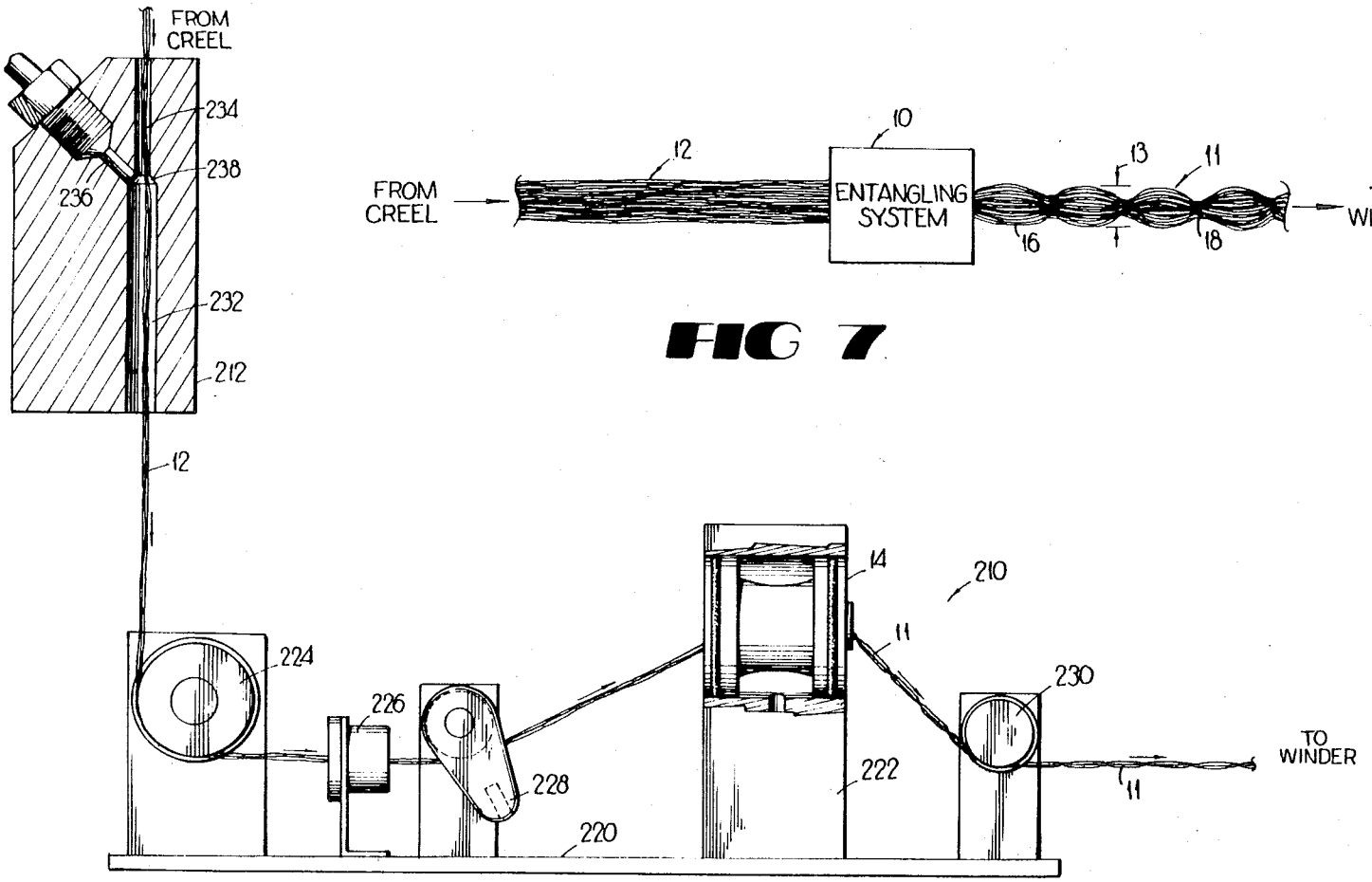
FIG. 7 shows an illustrative sample of multi-filament yarn before and after entangling using the entangling system and air entangling jets of the present invention.
FIG. 8 is a second embodiment of a system in accordance with the present invention for entangling yarn using an air entangling jet which system has a preferred tension isolator.

The effect of processing yarn through the entangling system is best illustrated in FIG. 7. The yarn illustrated in FIG. 7 is a single yarn comprising a number of individual continuous filaments having a zero twist. As previously noted, such yarn does not lend itself to ordinary textile operations because of the looseness of the individual filaments which may break and snag during such operations. In addition, such zero twist unconsolidated yarn 12 shown in FIG. 7 lacks bulk and therefore if used in tufting carpets, for example, it would not provide a satisfactory product. With continuing reference to FIG. 7, it can be seen that the entangled yarn 11 at the output of the entangling system 10 has a substantially different character. Particularly, the yarn 11 has alternating areas of bloom 16 and compacted tack areas 18. The tacks 18 give the yarn 11 integrity, and the blooms 16 having a height 13 provide desirable bulk in the yarn 11. The length of the blooms and tacks as well as the spacing between sequential tacks can be varied by adjusting the parameters of the entangling system 10 which variations will be discussed in greater detail below. In any event, it is important that whatever the length of tack, length of bloom, or length of period between the tacks, that the entangling system provides a consistent tacking pattern at the highest speed and the lowest possible air pressure and air flow. The present invention provides consistent tacks and blooms at high speed and at reduced air pressure and air flow.

Figure 2:
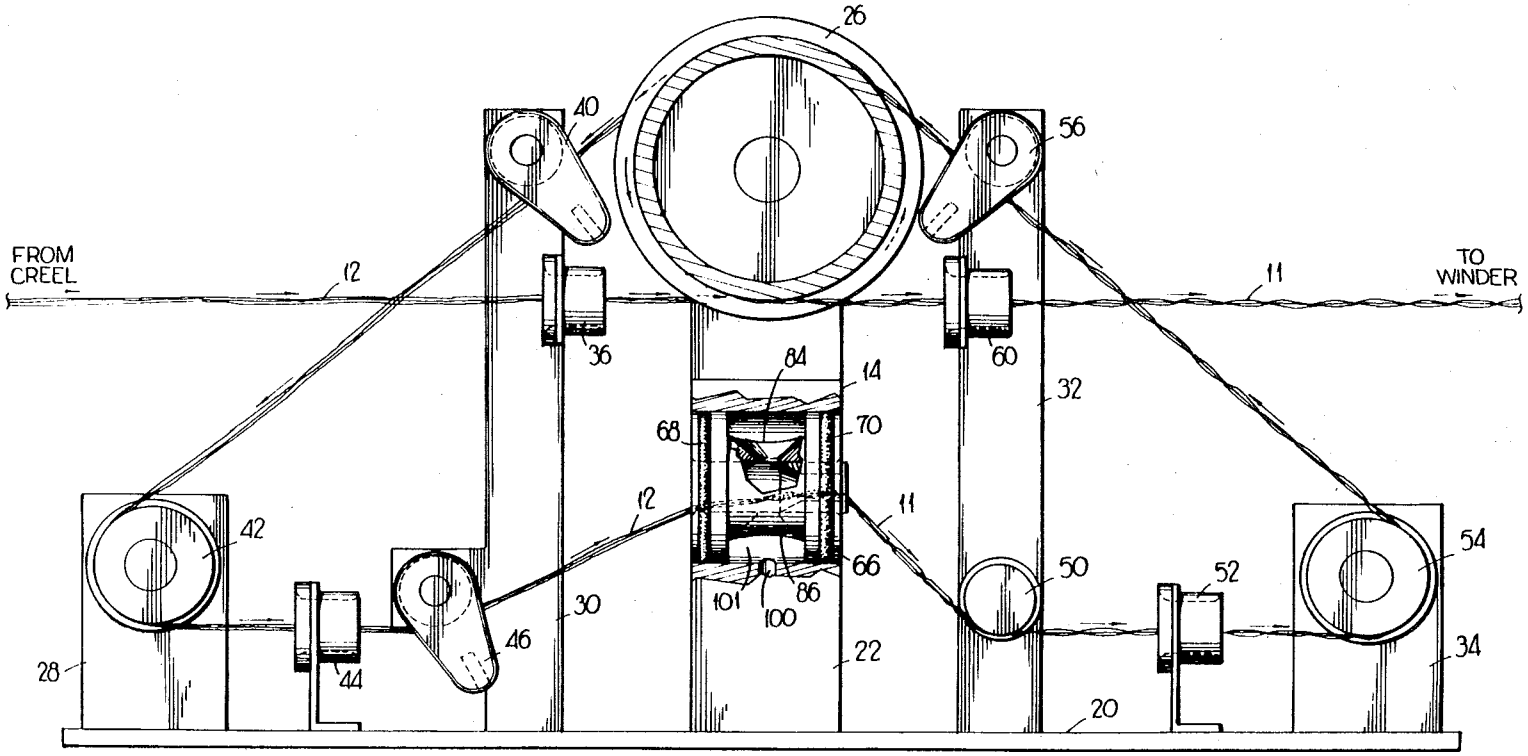
FIG. 2 is a side elevation view of the system in FIG. 1 for entangling yarn using an air entangling jet.
Figure 5:
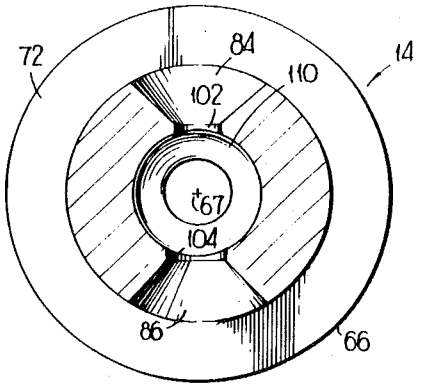
FIG. 5 is an axial section view of the air entangling jet of FIG. 4 as seen along line 5-5.

Returning to FIG. 1, the air entangling system 10 comprises a base 20 on which is mounted an air jet mounting block 22 having a cylindrical cavity 101 into which the air jet 14 is inserted. As shown in FIG. 2, the air jet mounting block 22 has a compressed air feed line 100 which supplies compressed air to the cavity 101. A bracket 24 supports an idle roll 26 above the mounting block 22. The idle roll is divided into sections 38 and 58 by means of center ridge 27. Brackets 28, 30, 32, and 34 are likewise mounted on base 20 to support a variety of yarn guides, the operation of which will be described below.

As the unentangled yarn 12 is drawn from the creel (not shown), it passes through eyelet 36 which is horizontally aligned with section 38 of the idle roll 26. The yarn is wrapped counter clockwise around approximately three quarters of the circumference of section 38 of idle roll 26 and passes through ceramic guide 40. The unentangled yarn 12 then passes around fixed spindle 42, through eyelet 44, and through yarn guide 46. As the yarn 12 exits the yarn guide 46, it is aligned horizontally with axis 67 of the cylindrical air jet 14, but it is aligned slightly below the axis 67 of the air jet 14 so that the yarn engages the lower edge of inlet 48 of the air jet 14. After passing through the entangling jet 14, the entangled yarn 11 exits the entangling jet 14 and passes around fixed spindle 50. Fixed spindle 50 holds the yarn below the axis 67 of the entangling jet 14 so that the entangled yarn 11 engages the lower edge of the outlet of the entangling jet. After passing fixed spindle 50, the entangled yarn 11 passes through eyelet 52, around fixed spindle 54, through yarn guide 56, and around section 58 of the idle roll 26 again in the counter clockwise direction. The entangled yarn 11 engages about three quarters of the circumference of section 58 of the idle roll 26 before passing through eyelet 60 on its way to the winder (not shown).

The idle roll 26 serves as a tension isolator to relieve the tensions that build up in the creel including ordinary frictional tension and dynamic whip tensions which may result as the yarn 12 is drawn at high speed from the creel toward the air entangling system 10. The fixed spindles 42, 50, and 54 not only provide yarn guidance to assure that the yarn enters and exits the air jet below the axis of the air jet but also provide fixed friction within the entangling system to assure that the yarn tension into and out of the air jet remains essentially constant during operation. With constant friction (and therefore tension) provided by the fixed spindles, changes in the process can be accounted for and controlled by varying the air pressure and air flow to the entangling jet 14.

Figure 4:
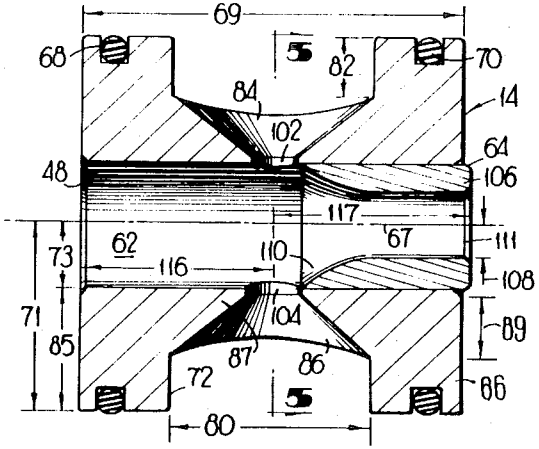
FIG. 4 is a longitudinal section of the air entangling jet used in connection with the air entangling systems of FIGS. 1 through 3.

Turned to FIG. 4, there is shown in greater detail the air jet 14. The air jet 14 comprises a cylindrical body 66 having axis 67, length 69, and radius 71. The cylindrical body 66 has an entangling chamber 62 which is co-axial and coterminous with the cylindrical body 66. The entangling chamber 62 has inlet 48, outlet 64, a radius 73, and a wall 87 having a thickness 85. The cylindrical body 66 is mounted within the cavity 101 of the mounting block 22 and is sealed within the cavity 101 by means of O rings 68 and 70 as can be best seen in FIG. 2.

The cylindrical body 66 has an annular air feed ring 72 cut around its circumference. The annular ring has a length 80 which is between 50% and 90% of the length 69 of the body 66. The annular ring also has a depth 82 which is between 40% and 70% of the chamber wall thickness 85. Consequently, it may be said that the annular ring provides a large air passage resulting in a fairly thin wall between the annular ring and the entangling chamber.

Diametrically opposed tapered air orifices 84 and 86 are drilled in the chamber wall 87 at right angles to the axis 67 so that the tapered orifices 84 and 86 interconnect the annular ring 72 and the entangling chamber 62. The cylindrical body 66 is mounted in the cavity 101 of the mounting block 22 as shown in FIG. 2 so that the air orifice 86 is on the bottom of the air jet 14 and is in direct alignment with the compressed air feed line 100 which provides compressed air to the entangling jet 14. The orifice 84, which is diametrically opposite orifice 86, has a smaller area at its intersection 102 with entangling chamber 62 as compared to the area of the intersection 104 where orifice 86 intersects the entangling chamber 62. For an air jet having a length 69 of one inch, we have found that the lower orifice 86 should be 0.138 inch in diameter at its intersection 104 and the upper orifice 84 should be 0.120 inch in diameter at its intersection 102. Particularly, we believe that the ratio of 0.138 to 0.120 is an appropriate scaling factor for scaling the orifices up or down depending on the length of the air jet.

There is also shown in FIG. 4 an outlet air dam 106 which is co-axial with the entangling chamber 62 and which extends between a point just adjacent the air orifices 84 and 86 to the outlet 64 of the entangling chamber 62. The outlet dam 106 has an inlet 110, an outlet 111, and a radius 108. The radius 108 is just large enough to accommodate the entangled yarn 11 exiting the air jet without producing significant drag. It should also be noted that the inlet 110 has a profile which is well rounded as that term is used and understood in *Machinery's Handbook*, Nineteenth Edition, 1971, by Oberg & Jones, Industrial Press, page 2239.

Figure 6:
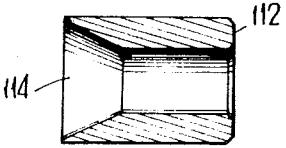
FIG. 6 is a cross section view of a second embodiment of an outlet dam for the air jet shown in FIG. 4.
Figure 3:
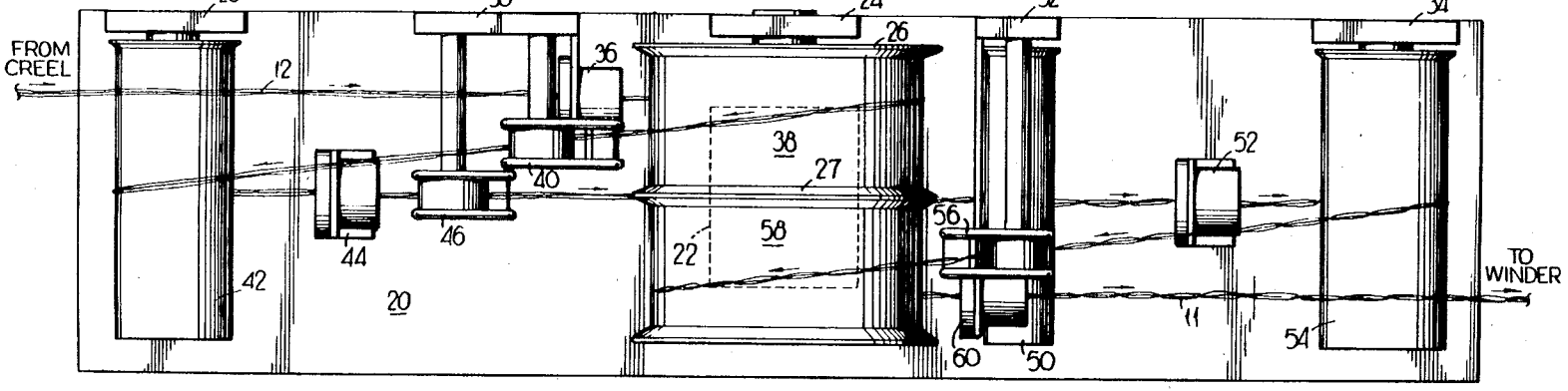
FIG. 3 is a top plan view of the system in FIG. 1 for entangling yarn using an air entangling jet.

FIG. 6 shows another embodiment of an outlet dam 112. The outlet dam 112 is in all respects the same as outlet dam 106 except that it has a tapered inlet 114 as compared to the well rounded inlet 110 of outlet dam 106. While the tapered outlet dam is useful in carrying out the present invention, we have found that an air pressure savings of between 5 and 10 psig may be achieved by using the well rounded inlet 110 as compared to the tapered inlet of 114. If a square off inlet instead of a tapered inlet for the dam is used, the air pressure requirements based on that change alone will increase anywhere from 15 to 20 psig above the air pressure required for the tapered dam.

In addition, we have discovered that by polishing all of the internal surfaces of the air jet 14, that increased efficiency can be achieved. Particularly, the surface of the air entangling chamber, the outlet dam, the annular ring, and the air orifices should be polished to at least 4–6 micro inches per inch root mean square (rms).

We have also discovered increased performance may be achieved by lengthening the inlet length 116 of the entangling chamber 62. The inlet length 116 is the length from the center of the air orifices 84 and 86 to the inlet 48. The inlet length 116 as shown in FIG. 4 is typically one-half the length 69 of the entangling chamber 62 or equal to outlet length 117. We have found that the inlet length 116 may be increased up to twice the outlet length 117. By increasing the inlet length, it appears that standing resonant waves may be created in the longer inlet length thereby creating more tension and greater opportunity for entangling as the yarn passes through the inlet length 116. In addition, as the inlet length is increased, the radius 73 of the entangling chamber may be increased to accomodate larger yarns without significant increases in air pressure or air flow.

Turning to FIG. 8 there is shown an alternative air entangling system which utilizes an air jet 14 and a frictionless yarn guide 212. Particularly, yarn 12 from the creel is drawn through the frictionless yarn guide 212 around a fixed spindle 224 through an eyelet 226 past a yarn guide 228 into the air jet 14. The entangled yarn 11 exiting the air jet 14 passes fixed spindle 230 and then on to the winder. The frictionless yarn guide 212 isolates the tensions in the yarn 12 as it comes from the creel. Particularly, the frictionless yarn guide 212 is intended to eliminate both the build up of frictional tension and the dynamic whip tensions that may result as the yarn 12 leaves the creel at high speed.

The frictionless guide at 212 comprises yarn feed chamber 232 which has a restricted inlet 234. Preferably the feed chamber 232 has a diameter of 3 times the diameter of the yarn being entangled, and the inlet 234 has a diameter of 1.5 times the diameter of the yarn. The yarn guide is 3.0 inches in length. An air orifice 236 communicates with the feed chamber 232 at point 238 where the restricted portion 234 widens into the main portion of the yarn feed chamber 232. The air orifice 236 is set at an angle of about 30 degrees to the axis of the yarn feed chamber 232 so that air is introduced into the yarn feed chamber at that angle toward the outlet of the yarn guide 212. Compressed air from the air orifice pulls the yarn into the frictionless guide 212 and aspirates the yarn out of the yarn feed chamber 232 while at the same time giving it a slight false twist. We have discovered that the slight false twist imparted to the yarn 12 as it exits the frictionless yarn guide is in the opposite direction as the false twist that the tangling jet of 14 tends to give the yarn as it enters the entangling jet 14. Consequently, the two false twists tend to cancel each other out so that the entangled yarn 11 exiting the entangling jet 14 has zero twist.

The operation of the entangling system and entangling air jets of the present invention is illustrated by the following examples.

EXAMPLE 1

The air entangling system of FIG. 8 was constructed. The frictionless yarn guide was dimensioned in accordance with the preferred embodiment and was operated at an air pressure of 30 psig and at an air flow of 5 cubic feet per minute (cfm). An adjustable needle valve is used to control the air volume in order to control the feed of the yarn through the frictionless guide. By adjusting yarn feed rate with respect to the speed of the winder, neutral take-up, overfeed, or underfeed may be provided. An air entangling jet having the following characteristics was used:

| | | |
|---|---|---|
| Length | 1.0 | inch |
| Inlet length | 0.5 | inch |
| Entangling chamber diameter | 0.375 | inch |
| Annular ring length | 0.625 | inch |
| Annular ring depth | 0.250 | inch |
| Air Dam | | no |
| Air orifice | | |
| Single no taper diameter | 0.157 | inch |

The following process parameters were used:

| | |
|---|---|
| Yarn (nylon) | 3 strands each 1800 denier (5400 denier total) |
| Yarn speed | 824 m./min. |
| Air pressure | 140 psig |
| Air flow | 39 cfm |

The air entangling system performed unsatisfactorily. Entangling skips were frequent and range up to one foot in length.

EXAMPLE 2

The air entangling system was set up the same as in Example 1 except for the air orifice. Diametrically opposed air orifices with no taper were used. The two orifices had the same total opening arear as the single orfice on Example 1. The orifice opening area was divided equally between the two diametrically opposed orifices. Each orifice was 0.111 in diameter. The same yarn as Example 1 was run at the same operating parameters as Example 1:

| | |
|---|---|
| Yarn speed | 824 m./min. |
| Air pressure | 140 psig |
| Air flow | 39 cfm |

The yarn was not successfully entangled and exhibited random skips of up to one foot in length.

EXAMPLE 3

The air entangling system was set up the same as Example 2 except that the diametrical opposed untapered orifices had different diameters, although the total orifice opening area remained the same. The lower orifices had a diameter of 0.138 inch, and the upper orifice had a diameter of 0.120 inch. The same yarn as Examples 1 and 2 was run with the following parameters.

| | |
|---|---|
| Yarn speed | 824 m./min. |
| Air pressure | 110 psig |
| Air flow | 39 cfm |

The yarn was successfully entangled having only from 10 to 15 single tack skips per 20 meters of entangled yarn. Such entanglement would generally be considered commercially acceptable. The periodic tack spacing was approximately 1 inch, the bloom length was approximately $\frac{7}{8}$ inch, and the bloom height was about two times the diameter of the yarn under tension before entangling.

EXAMPLE 4

The air entangling system was the same as that used in Example 3 except that the diametrically opposed orifices having different diameters were now provided with a taper as illustrated in FIG. 4. The same yarn was run with the following parameters:

| | |
|---|---|
| Yarn speed | 824 m./min. |
| Air pressure | 100 psig |
| Air flow | 45 cfm |

The yarn exhibited good entanglement consistent with the entanglement of Example 3. It should be noted that the increase in air flow from 39 cfm to 45 cfm indicates that the dual orifices may both be reduced in size to limit the air flow back to 39 cfm and still provide the same good entanglement at pressure lower than 100 psig. The entangled yarn had a tack period of approximately 1 inch, a bloom length of approximately $\frac{7}{8}$ inch, and a bloom height of about two times the diameter of the yarn under tension before entangling.

EXAMPLE 5

The air entangling system was set up the same as Example 4 except that an outlet dam having an inter diameter of 0.1875 inch was added to the air jet as shown in FIG. 4. The outlet dam had a well rounded inlet. The same yarn was run with the following parameters:

| | |
|---|---|
| Yarn speed | 824 m./min. |
| Air pressure | 80 psig |
| Air flow | 29 cfm |

The yarn was entangled satisfactorily having a tack period of approximately 1 inch, a bloom length of approximately $\frac{7}{8}$ inch, and a bloom height of about two times the diameter of the yarn under tension before entangling.

EXAMPLE 6

The air entangling system of FIG. 8 was again set up. An entangling jet having the following characteristics was used:

| | |
|---|---|
| Length | 1.0 inch |
| Inlet length | 0.5 inch |
| Entangling chamber diameter | 0.3125 inch |
| Annular ring length | 0.625 inch |
| Annular ring depth | 0.25 inch |

-continued

| | |
|---|---|
| Air dam inner diameter | 0.125 inch |
| Air dam inlet shape | well rounded |
| Air orifice | |
| Two orifices diametrically opposed | yes |
| Tapered | yes |
| diameter (lower) | 0.138 |
| diameter (upper) | 0.120 |

The following process parameters were used: Yarn (nylon) 1 strand 1300 denier/80

| | |
|---|---|
| Yarn (nylon) | 1 strand 1300 denier/80 filament |
| Yarn speed | 824 m./min. |
| Air pressure | 40 psig. |
| Air flow | 10 cfm |

The yarn entanglement was good with only 10 to 15 skipped single tacks per 20 meters. The tacks were soft. By increasing the air pressure to 50 psig and air flow to 12 cfm good entanglement resulted with only 10 to 15 skipped tacks per 20 meters with much harder tacks. The entangled yarn had a tack period of approximately 1 inch, a bloom length of approximately $\frac{3}{4}$ inch, and a bloom height of about two times the diameter of the yarn under tension before entangling.

EXAMPLE 7

The air entanglement system was set up the same as in Example 6 except that instead of a single strand of yarn, 2 strands of nylon yarn each 1300 denier/80 filament were entangled with the following operating parameters:

| | |
|---|---|
| Yarn speed | 824 m./min. |
| Air pressure | 50 psig |
| Air flow | 12 cfm |

Entanglement was fair with soft tacks. At an air pressure of 60 psig and at an air flow of 15 cfm, good entanglement with good solid tacks was achieved. The tack period was approximately 1 inch, the bloom length was approximately $\frac{3}{4}$ inch, and the bloom height was about two times the diameter of the yarn under tension before entangling.

EXAMPLE 8

The same air entanglement system as Example 6 was set up except that three strands of nylon yarn each 1300 denier/80 filament were entangled as follows:

| | |
|---|---|
| Yarn speed | 824 m./min. |
| Air pressure | 60 psig |
| Air flow | 15 cfm |

Good entanglement was achieved with soft tacks. At an air pressure of 70 psig and at an air flow of 18 cfm, good hard tacks were accomplished. The tack period was approximately 1 inch, the bloom length was approximately $\frac{3}{4}$ inch, and the bloom height was about two times the diameter of the yarn under tension before entangling.

We claim:

1. An air entangling jet comprising:

(a) a cylindrical body having a body length and a body diameter for insertion in a mounting block having an air feed passage.

(b) a cylindrical entangling chamber in the body having a chamber diameter a chamber length, a chamber wall having thickness, an inlet, and an outlet;

(c) an annular air feed ring around the body having a ring length that is between 50% and 90% of the body length and having a depth that is between 40% and 70% of the chamber wall thickness; and (d) diametrically opposed tapered orifices in the chamber wall for communicating between the entangling chamber and the annular feed ring, wherein the diametrically opposed tapered orifices comprise a first orifice having a cross section and aligned with the air feed passage of the mounting block and a second diametrically opposed orifice having a cross section that is smaller than the cross section of the first orifice.

2. The air entangling jet of claim 1, wherein the entangling chamber has a surface, the annular ring has a surface, and the orifices have surfaces, all of which surfaces are polished to finish smoother than 4–6 micro inch per inch rms.

3. The air entangling jet of claim 2, wherein an outlet dam having a restricted bore is positioned within the entangling chamber and extends from adjacent the orifices to the outlet of the entangling chamber to restrict the outlet of the entangling chamber.

4. The air entangling jet of claim 3, wherein the bore of the outlet dam has an entrance that is well-rounded, and the entrance and bore are polished smoother than 4–6 micro inch per inch rms.

5. The air entangling jet of claim 3, wherein the entangling chamber has an inlet length between the inlet and the orifices which length is equal to and greater than an outlet length between the orifices and the outlet but the inlet length is less than twice the outlet length.

6. The air entangling jet of claim 1, wherein an outlet dam having a restricted bore is positioned within the entangling chamber and extends from adjacent the orifices to the outlet of the entangling chamber to restrict the outlet of the entangling chamber.

7. The air entangling jet of claim 6, wherein the bore of the outlet dam has an entrance that is well-rounded, and the entrance and bore are polished smoother than 4–6 micro inch per inch rms.

8. The air entangling jet of claim 6, wherein the entangling chamber has an inlet length between the inlet and the orifices which length is equal to and greater than an outlet length between the orifices and the outlet but the inlet length is less than twice the outlet length.

9. A system for entangling yarn as the yarn is drawn from a creel by a winder comprising:

(a) An air entangling jet comprising:

(i) a cylindrical body having a body length and a body diameter for insertion in a mounting block having an air feed passage;

(ii) a cylindrical entangling chamber in the body having a chamber diameter, a chamber length, a chamber wall having a thickness, an inlet, and an outlet;

(iii) an annular air feed ring around the body having a ring length that is between 50% and 90% of the body length and having a depth that is between 40% and 70% of the chamber wall thickness; and (iv) diametrically opposed tapered orifices in the chamber wall for communicating between the entangling chamber and the annular feed ring; and (b) A tension isolator positioned between the creel and inlet of the entangling chamber comprising a frictionless yarn guide having a feed chamber with a restricted guide inlet and a guide outlet and having an air feed orifice communicating with the feed chamber at an angle so that air from the feed orifice is directed toward the feed outlet to aspirate the yarn out of the feed outlet toward the inlet of the entangling chamber.

10. The air entangling jet of claim 9, wherein the diametrically opposed tapered orifices comprise a first orifice having a cross section and aligned with the air feed passage of the mounting block and a second diametrically opposed orifice having a cross section that is smaller than the cross section of the first orifice.

11. The air entangling jet of claim 9 or 10, wherein an outlet dam having a restricted bore is positioned within the entangling chamber and extends from adjacent the orifices to the outlet of the entangling chamber to restrict the outlet of the entangling chamber.

12. The air entangling jet of claim 11 wherein the bore of the outlet dam has an entrance that is well-rounded, and the entrance and bore are polished smoother than 4–6 micro inch per inch rms.

13. The air entangling jet of claim 11, wherein the entangling chamber has an inlet length between the inlet and the orifices which length is equal to and greater than an outlet length between the orifices and the outlet but the inlet length is less than twice the outlet length.

14. The air entangling jet of claim 9 or 10, wherein the entangling chamber has a surface, the annular ring has a surface, and the orifices have surfaces, all of which surfaces are polished to a finish smoother than 4–6 micro inch per inch rms.

15. The air entangling jet of claim 14, wherein an outlet dam having a restricted bore is positioned within the entangling chamber and extends from adjacent the orifices to the outlet of the entangling chamber to restrict the outlet of the entangling chamber.

16. The air entangling jet of claim 15 wherein the bore of the outlet dam has an entrance that is well-rounded, and the entrance and bore are polished smoother than 4–6 micro inch per inch rms.

17. The air entangling jet of claim 15, wherein the entangling chamber has an inlet length between the inlet and the orifices which length is equal to and greater than an outlet length between the orifices and the outlet but the inlet length is less than twice the outlet length.

* * * * *